US005909898A

United States Patent [19]

Faraj

[11] Patent Number: 5,909,898

[45] Date of Patent: Jun. 8, 1999

[54] NOTEPAD WITH PEN AND KEY HOLDER

[76] Inventor: Abdul-Razzak Faraj, P.O. Box 566068, Atlanta, Ga. 31156

[21] Appl. No.: 08/950,340

[22] Filed: Oct. 14, 1997

[51] Int. Cl.[6] ..... B42D 3/00

[52] U.S. Cl. ..... 281/30; 281/51; 281/44

[58] Field of Search ..... 281/30, 28, 44, 281/51; 70/459; 206/37.5

[56] References Cited

U.S. PATENT DOCUMENTS

| | | | |
|---|---|---|---|
| 1,407,239 | 2/1922 | Weiss | 281/30 X |
| 2,486,840 | 11/1949 | Harris | 281/30 X |
| 2,680,628 | 6/1954 | Berman | 281/51 X |
| 5,006,699 | 4/1991 | Felkner et al. | 281/30 X |

*Primary Examiner*—Willmon Fridie, Jr.
*Attorney, Agent, or Firm*—John L. James

[57] ABSTRACT

A combination notepad and key holder has a notepad with a top binder. A holder for holding writing instrument is attached to one end the top binder. A flexible strap has one end connected to the top binder portion and has a distal end connected to a key holder. The key holder has a U-shaped frame with a push bar biased with a spring to a closed position closing off an open end of the U to retain a key on the push bar. The push bar is moveable against the force of the spring to an open position to remove the key from the push bar.

3 Claims, 2 Drawing Sheets

NOTEPAD WITH PEN AND KEY HOLDER

FIELD OF THE INVENTION

The present invention relates generally to notepads and, more particularly, to a notepad with attachments.

BACKGROUND OF THE INVENTION

Shoppers are often confronted with trying to remember brand name, prices, shelf location, and other things when shopping. It is desirable to have notepad, when shopping for example, that has a pen attached for recording shopping information. Such a notepad is hand held or rests in a shopping cart. Shoppers are also confronted with what to do with keys. On the one hand, keys should be safely stored in a purse or pocket, but, on the other hand, at least one key, such as an automobile key, should remain easily accessible. Because the shopper always has the notepad handy, it would be a convenient place to keep a key. Accordingly, it will be appreciated that it would be highly desirable to have a notepad that has a pen and a key holder.

SUMMARY OF THE INVENTION

Briefly summarized, according to one aspect of the present invention, an apparatus, comprises a notepad having a top binder portion with first and second end portions; a holder for holding a writing instrument attached to the first end portion of the top binder portion; a flexible strap having one end connected to the second end portion of the top binder portion and having a distal end; and a key holder attached to the distal end of the strap and having a U-shaped frame with a push bar biased with a spring, the spring biasing the push bar to a closed position closing off an open end of the U to retain a key on the push bar, the push bar being moveable to an open position to remove the key from the push bar.

A pen attaches to the pen holder and is available for taking notes while shopping. A car key attaches to the key holder so that it is ready for easy access to an automobile in a parking lot.

These and other aspects, objects, features and advantages of the present invention will be more clearly understood and appreciated from a review of the following detailed description of the preferred embodiments and appended claims, and by reference to the accompanying drawings.

DETAILED DESCRIPTION 0F THE PREFERRED EMBODIMENTS

Figure 1:
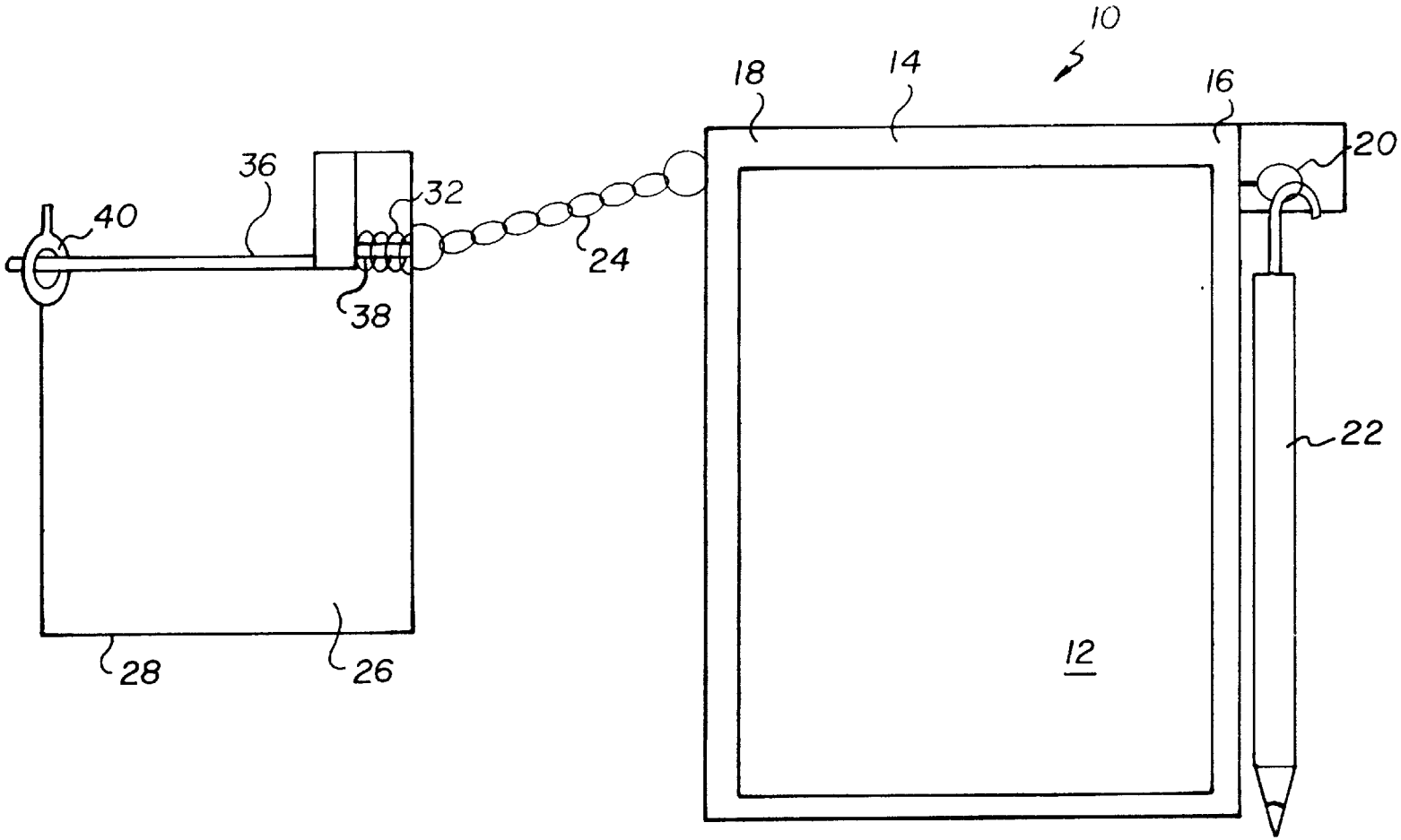
FIG. 1 is a diagrammatic plan view of a notepad with a pen and key holder according to the present invention.
Figure 2:
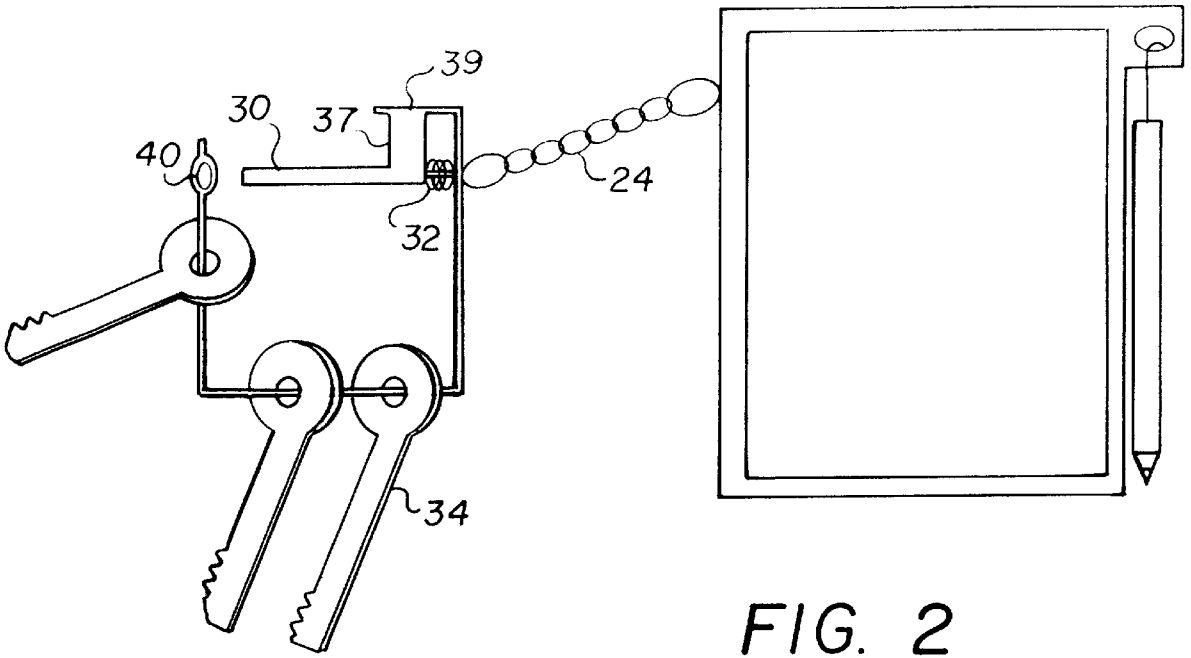
FIG. 2 is a diagrammatic plan view similar to FIG. 1 but showing the key holder open to receive keys.

Referring to FIGS. 1–2, a notepad 10 has paper 12 for note taking and a top binder 14 for holding the paper. Binder 14 may be a separate binder or simply the top portion of the papers bonded together as is known in the art. A separate binder is preferable so that the pad of paper can be replaced when exhausted. Binder 14 has a first end portion 16 and a second end portion 18.

A pen holder 20 is attached to the first end portion 16 of the binder 14 for holding a writing instrument, such as pen

22, for example. Pen holder 20 may take the form of a simple eyelet that engages a hook on the pen, or may be a contoured holder with a cavity for holding the pen.

A flexible strap 24 has one end connected to the second end portion 18 of the binder 14 and has a distal end connected to a key holder 26. Strap 24 may be constructed of a strong durable material, such as leather, or may be a chain. The key holder 26 is attached to the distal end of the flexible strap 24 and has a U-shaped same 28 with a push bar 30 biased by coil a spring 32. The spring 32 biases the push bar to a closed position closing off an open end of the U to retain a key 34 on the push bar. The push bar is moveable to an open position to remove the key.

Figure 3:
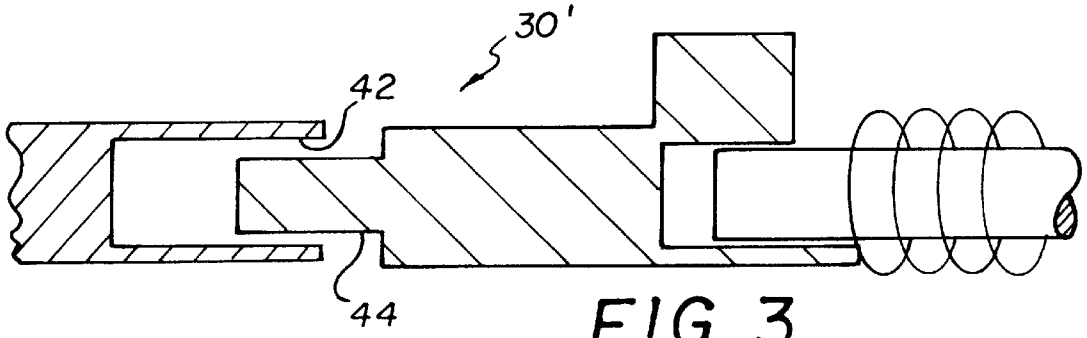
FIG. 3 is a somewhat enlarged diagrammatic view of a push bar similar to the push bar of FIG. 1 but illustrating another preferred embodiment.

The push bar 30 consists of an outer member 36 with an internal opening extending longitudinally and an inner member 38 with one end connected to the frame and the other end protruding into the outer member 36. Coil spring 32 is entrained about the inner member 38 abutting the frame 28 and outer member 36. Push bar 30 includes a push button 37 that abuts and slides along a top extension 39 of the frame 28. Push button 37 is preferably biased by the spring 32 to a position where it is flush with top extension 39 and is pushed into the frame against the force of the spring to accept keys. The push bar 30 preferably protrudes through an open loop 40 in the fame 28. Alternatively, a push bar 30' may have one portion containing a socket or opening 42 that receives a protrusion 44 from another portion (FIG. 3). Covering the frame with plastic or leather enhances aesthetic appeal and hides the key.

while the invention has been described with particular reference to the preferred embodiments, it will be understood by those skilled in the aft that various changes may be made and equivalents may be substituted for elements of the preferred embodiments without departing from invention. For example, the pen holder and key holder may be interchanged for the convenience of left handed users. As is evident from the foregoing description, certain aspects of the invention are not limited to the particular details of the examples illustrated, and it is therefore contemplated that other modifcations and applications will occur to those skilled in the art. It is accordingly intended that the claims shall cover all such modifications and applications as do not depart from the true spirit and scope of the invention.

What is claimed is:

1. An apparatus, comprising:

a notepad having a top binder portion with first and second end portions;

a holder for holding a writing instrument attached to said first end portion of said top binder portion;

a flexible strap having one end connected to said second end portion of said top binder portion and having a distal end; and a key holder attached to said distal end of said flexible strap and having a U-shaped frame with a push bar biased with a spring, said spring biasing said push bar to a closed position closing off an open end of the U to retain a key on said push bar, said push bar being moveable to an open position to remove the key from said push bar.

2. An apparatus, as set forth in claim 1, wherein said push bar includes a push button operable to move said push bar between the open and closed positions.

3. An apparatus, as set forth in claim 1, wherein said push button is flush with said frame when said push bar is at the closed position.

* * * * *